United States Patent [19]

Luckenbill

[11] 4,227,544

[45] * Oct. 14, 1980

[54] FIRE HYDRANT WITH IMPROVED SHOE AND VALVE

[75] Inventor: Lawrence F. Luckenbill, Decatur, Ill.

[73] Assignee: Mueller Co., Decatur, Ill.

[ * ] Notice: The portion of the term of this patent subsequent to Dec. 11, 1996, has been disclaimed.

[21] Appl. No.: 5,848

[22] Filed: Jan. 23, 1979

Related U.S. Application Data

[63] Continuation of Ser. No. 762,511, Jan. 26, 1977, Pat. No. 4,177,826.

[51] Int. Cl.[3] ..... E03B 9/08; F16K 27/00

[52] U.S. Cl. ..... 137/307; 138/DIG. 11; 251/366

[58] Field of Search ..... 137/272, 280, 282–287, 137/289, 294, 301–308; 138/DIG. 11; 4/DIG. 7; 251/366

[56] References Cited

U.S. PATENT DOCUMENTS

| | | | |
|---|---|---|---|
| 149,628 | 4/1874 | Allen | 137/307 |
| 242,243 | 5/1881 | Adams | 137/305 X |
| 1,021,537 | 3/1912 | Lawnin | 137/301 X |
| 1,091,210 | 3/1914 | Gauntt | 137/283 |
| 1,349,062 | 8/1920 | Goldberg | 137/283 |
| 2,083,319 | 6/1937 | Daviet | 137/299 |
| 2,626,629 | 1/1953 | Mueller et al. | 137/283 |
| 3,219,054 | 11/1965 | Elder et al. | 137/307 |
| 3,980,096 | 9/1976 | Ellis et al. | 137/283 |
| 4,177,826 | 12/1979 | Luckenbill | 137/307 |

FOREIGN PATENT DOCUMENTS

| | | | |
|---|---|---|---|
| 2157748 | 6/1973 | Fed. Rep. of Germany | 138/DIG. 11 |

*Primary Examiner*—Alan Cohan
*Assistant Examiner*—Richard Gerard
*Attorney, Agent, or Firm*—Cushman, Darby & Cushman

[57] ABSTRACT

A fire hydrant having a generally elbow-shaped hydrant shoe with an improved interior bowl configuration and an improved hydrant valve for minimizing head or flow loss of the fire hydrant between the inlet opening of the shoe and the outlet nozzle positioned on the upper portion of the hydrant barrel. The interior bowl of the shoe, adjacent its inlet, is provided with a diverging transitional surface of rotation having a generally part frusto conical shape and, adjacent its outlet, is provided with a converging transitional surface of rotation having a generally part frusto conical shape, the transitional surfaces of rotation merging with the shoe's part spherical chamber. The valve element of the hydrant valve is provided with a generally conically shaped converging surface on its downstream side which when open defines with said converging transitional surface of rotation and with a portion of said diverging surface of rotation an annular passage for the flow of fluid through the hydrant shoe into the hydrant barrel, the annular passage varying in radial section from a diverging radial section to a converging radial section.

24 Claims, 11 Drawing Figures

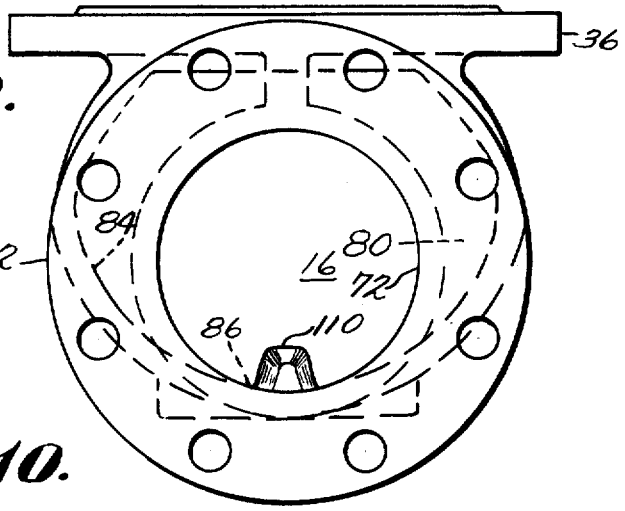
Fig. 8.
Fig. 10.
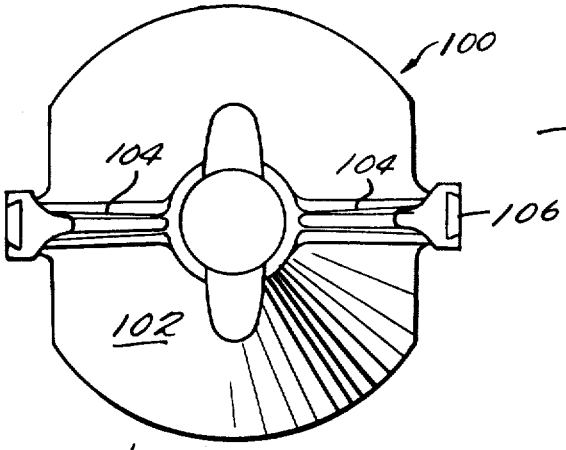
Fig. 9.
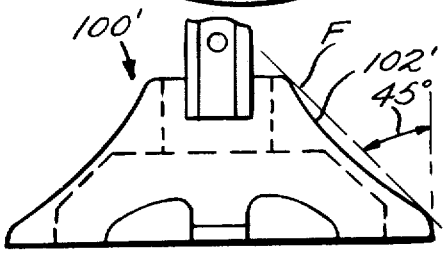
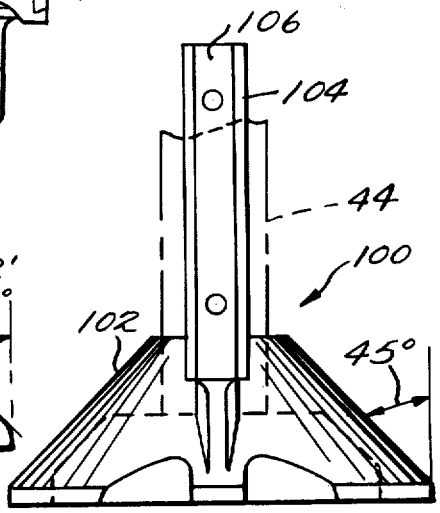
Fig. 11.

FIRE HYDRANT WITH IMPROVED SHOE AND VALVE

This is a continuation of application Ser. No. 762,511 filed Jan. 26, 1977 and now U.S. Pat. No. 4,177,826.

The present invention relates to improvements in fire hydrants and, more particularly to an improvement in a dry barrel fire hydrant wherein the interior bowl configuration of the hydrant shoe and/or the configuration of the valve element minimizes flow loss of the fire hydrant between the inlet opening of the hydrant shoe and the outlet nozzle of the barrel of the hydrant by providing substantially uniform flow of fluid through the shoe resulting in a uniform velocity of flow through the shoe.

BACKGROUND OF THE INVENTION

Manufacturers today produce several sizes of fire hydrants for customers to select. Usually customers select the fire hydrant size based on some form of capacity criteria and they choose one hydrant over another hydrant on the basis of established capacity, and more specifically, head or flow loss. The American Water Works Association as well as Underwriters Labratories provided standards for the industry which ignore hydrant size when spelling out acceptable head or flow loss, these standards grouping together all sizes of hydrants in setting a standard not to exceed a set value of 5.0 pounds per square inch at 1000 gallons per minute. The American Water Works Association standard is identified as standard C502, whereas the Underwriters Labratories standard is identified as standard 246.

Most dry barrel fire hydrants on the market today have heard losses which approach 5 psi and usually lie in a range of 3.5 psi to 5.0 psi at 1000 gpm. In this respect, the hydrant's shoe design involves utilizing an elbow-shaped shoe which may or may not have a part spherical chamber therein but when such hydrants do have a part spherical chamber therein, the sphere center is usually located on the intersection of the axis of the inlet passage of the shoe and the axis of the outlet passage and, in some instances, the special chamber has a radius of curvature greater than the radius of the inlet passage of the shoe whereas in other instances the spherical chamber has a radius of curvature equal to radius of the inlet passage of the shoe. Consequently, when the hydrant valve is open and is lowered down into the bowl of the hydrant shoe and the flow of fluid through the inlet passage enters the shoe it impinges on the hydrant valve as well as on the back spherical surface of the shoe where it splits resulting in turbulence within the shoe causing flow losses between the inlet opening of the shoe and the outlet nozzle on the barrel of the hydrant. This situation generally follows for a hydrant that has a conventional elbow-shape without a spherical portion in the shoe bowl or chamber.

More recent designs of fire hydrant shoes have found that some of the head or flow losses of the hydrants can be reduced by providing a part spherical chamber with a spherical center positioned above the axis of the cylindrical inlet passage to the shoe and on the axis of the cylindrical outlet passage from the shoe with the radius of curvature of the part spherical chamber being greater than the radius of the inlet passage and the part spherical chamber merging smoothly with the inlet passage adjacent its lowest portion. However, this type of fire hydrant did not take into consideration the provisions of providing a smooth transitional surface between the entire inlet passage and the part spherical chamber especially in the area where the flow path changes from horizontal to vertical nor providing a smooth transitional surface where flow leaves the shoe chamber around the valve and enters the barrel of the hydrant. The sharp or sudden changes of shape from the cylindrical inlet passage to the larger spherical shape and the sudden or sharp changes of shape from the spherical shape of the shoe to the outlet passage of the shoe still resulted in some turbulence causing flow or head losses in the hydrant. There was no gentle expansion in the flow way in an area where the inlet flow into the shoe impinges on the open main valve and there was no maintaining of a uniform velocity of flow around the open main valve and smooth flow from the shoe into the barrel.

For the most part, hydrants of the prior art did not appreciate that the configuration of the upper surface of the valve element also contributes to head or flow loss in the hydrant. Usually, the valve element was provided with an upper valve plate which was generally flat and thus had no effect in controlling the flow of fluid through and out of the hydrant shoe. Such arrangements resulted in considerable turbulence particularly around the upwardly extending valve stem. However, some valve elements have been made with an upper surface which is generally conically shaped but these valve elements were not utilized in shoe designs which minimized turbulence of fluid flowing into the shoe as well as minimized turbulence of fluid flowing from the shoe around the valve element.

PRIOR ART

Prior art relating to valve flow transition and to shoe and valve construction of fire hydrants are as follows:

| | | |
|---|---|---|
| 242,243 | W.L. Adams | May 31, 1881 |
| 1,021,537 | A.W. Lawnin | March 26, 1912 |
| 2,555,727 | W.W. Bolser | June 5, 1951 |
| 3,586,019 | D.F. Thomas | June 22, 1971 |
| 3,599,662 | J.W. Dashner | August 17, 1971 |
| 3,643,914 | E.A. Bake | February 22, 1972 |
| 3,980,096 | D.A. Ellis | September 14, 1976. |

BRIEF SUMMARY OF THE INVENTION

Briefly stated, the present invention relates to an improvement in a fire hydrant and, more particularly, to an improved interior bowl configuration of the hydrant shoe which coupled with a valve, minimizes flow of head loss of the fire hydrant between the inlet opening to the shoe and the outlet nozzle of the hydrant barrel. In more detail, the hydrant comprises a barrel closed at its upper end and open at its lower end, the barrel having at least one outlet nozzle adjacent its upper end, an elbow-shaped hydrant shoe with an upwardly opening mouth, the hydrant shoe being attached to the lower open end of the barrel and the shoe having its inlet opening lying in a plane substantially 90° to its upwardly opening mouth, the inlet opening being arranged to be attached to a water main. A downwardly facing valve seat ring is positioned in one end of the shoe adjacent the upwardly opening mouth and a hydrant valve element is arranged to seat on said valve seat ring and to be opened downwardly by a reciprocating valve stem extending from the valve element upwardly within the barrel. Valve operating means are connected to the valve stem and extend out of the closed end of the hydrant barrel. The shoe bowl configuration for minimizing head or flow loss of the fire hydrant between the inlet opening of the shoe and the outlet nozzle comprise a cylindrical inlet passage extending from the inlet opening to a part spherical chamber and a cylindrical outlet passage extending vertically downwardly from the upwardly facing opening and also communicating with the part spherical chamber. The shoe is further provided with a diverging transitional surface of rotation which is generally part frusto conical in shape and has an axis generally parallel to the axis of the cylindrical inlet passage, the transitional surface of rotation extending smoothly from a plane perpendicular to the cylindrical inlet passage and smoothly merging with the part spherical chamber at tangential intersections with the same. The converging transitional surface of rotation is also generally part frusto conical in shape and has an axis generally parallel to the axis of the vertical cylindrical outlet passage and it extends smoothly from tangential intersections with the part spherical chamber to a plane extending perpendicularly to an axis of the cylindrical outlet passage. The converging transitional surface also merges smoothly with at least a part of the diverging transitional surface.

The part spherical chamber of the hydrant shoe has a spherical center positioned above the axis of the cylindrical inlet passage and on the axis of the cylindrical outlet passage with a radius of curvature greater than the radius of the inlet passage. The arrangement of shoe configuration including the provision of diverging and converging transitional surfaces of rotation coupled with a part spherical chamber provides for a gentle expansion of fluid in the flow way in the inlet area of the shoe as well as a uniform velocity of flow through the shoe around the valve and out of the shoe into the barrel which reduces head or flow loss in the hydrant.

To further enhance minimizing head or flow loss in the hydrant, the valve element for the hydrant is provided with a frusto conical surface of rotation on its downstream side which cooperates with the converging and diverging surfaces of rotation when the hydrant is open to provide an annular flow passage around the valve element which has a diverging radial section which varies to a converging radial section so as to provide flow of fluid resulting in substantially uniform velocity of flow through the shoe.

It has been discovered that the maximum angle of the diverging surface of rotation of the shoe with respect to the horizontal axis of the cylindrical inlet passage should be in the range of 25° to 35° and preferably in the order of 30° whereas the converging surface of rotation of the shoe has a maximum angle relative to the vertical axis of the cylindrical outlet passage in the range of 30° to 45° and preferably in the order of 38°. Coupled with this, the generally frusto conical surface of rotation on the downstream side of the valve element has an angle relative to the vertical axis of the cylindrical outlet passage in the range of 40° to 50° and preferably in the order of 45°. The maximum angle of said converging transitional surface of rotation of the shoe is greater than the maximum angle of the diverging transitional surface of rotation of the shoe.

BRIEF DESCRIPTION OF THE DRAWINGS

FIG. 8 is an end elevational view of the shoe of FIG. 6 looking from the right to the left thereof;

FIG. 9 is a side elevational view of the improved upper valve plate of the valve element of the fire hydrant of the present invention;

FIG. 10 is a top plan view of the upper valve plate of the valve element of FIG. 9; and FIG. 11 is a fragmentary side elevational view of a modified form of the upper valve plate of the valve element for the hydrant of the present invention.

DETAILED DESCRIPTION OF THE INVENTION

Figure 1:
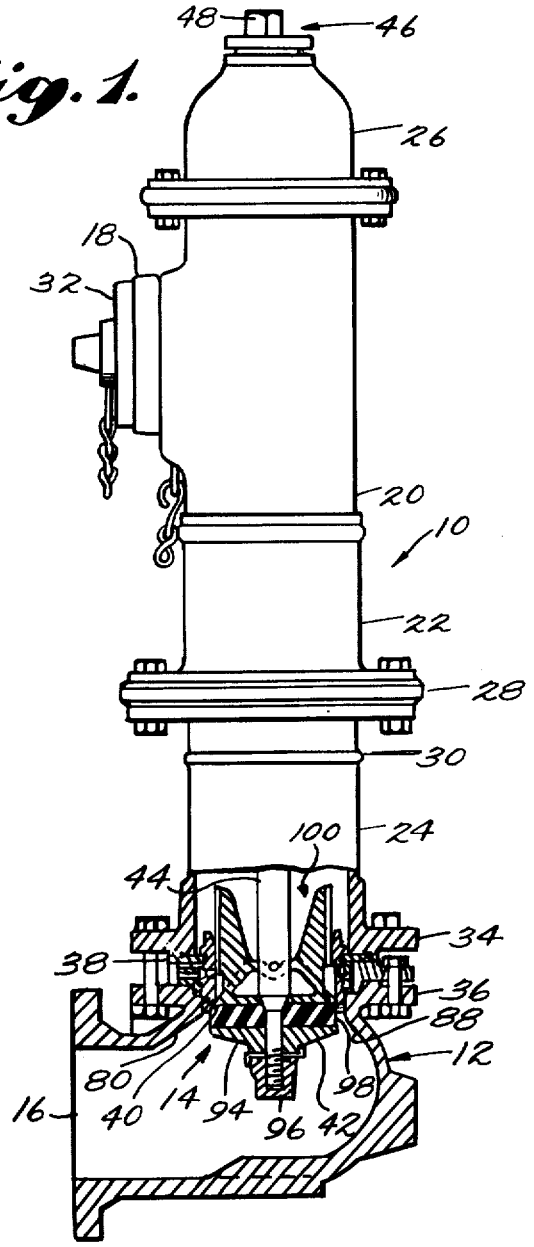
FIG. 1 is a side elevational view of a fire hydrant embodying the present invention, a lower portion of the hydrant being shown in vertical section and with the valve element in the closed position.

Referring now to the drawings wherein like characters and reference numerals represent like or similar parts, there is disclosed in FIGS. 1 and 5–11 inclusive a fire hydrant of the present invention generally designated by the numeral 10, the fire hydrant 10 having an improved generally elbow-shaped shoe 12 and main hydrant valve 14 which results in minimizing head or flow loss between the shoe inlet opening 16 and the at least one outlet or pumper nozzle 18. In more detail, the fire hydrant 10 is provided with a barrel 20 comprising an upper barrel section 22 and a lower barrel section 24, the barrel 20 being closed at its upper end by a bonnet or cover 26 and open at its lower end. The upper barrel section 22 is connected to the lower barrel section 24 by a frangible coupling 28 positioned just above the bury line 30. The upper barrel section 22 maybe provided with one or more of the outlet nozzles 18, the outlet nozzles 18 being normally closed by a removable nozzle closure 32.

As shown in FIG. 1, the lower barrel section 24 of the barrel 20 is provided with a peripheral flange 34 whereas the hydrant shoe 12 is also provided with a peripheral flange 36. The main hydrant valve 14 includes a hydrant valve seat ring member 38 having a downwardly facing valve seat 40, the valve seat ring member 38 being clamped between the flanges 34 and 36 in a manner similar to that shown in U.S. Pat. No. 3,980,096 issued Sept. 14, 1976 to Ellis et al and assigned on its face to the common assignee of this application, namely, Mueller Company, Decatur, Ill. For the purpose of this disclosure, details of the valve seat ring member 38 maybe found in the aforementioned U.S.

Pat. No. 3,980,096, the subject matter of this patent being incorporated by reference herein. Of course, the valve seat ring member 38 rather than being supported between the flange 34 of the lower barrel section 24 and the flange 36 of the shoe 12, may be supported directly within the outlet passage of the shoe 12 or within the open lower end of the barrel section 24 as is commonplace in the art.

A movable valve element 42 of the main hydrant valve 14 is arranged to seat on downwardly facing valve seat 40 of the valve seat ring member 38 when the valve is in a closed position and to move downwardly when it is desired to open the main hydrant valve for the flow of water through the barrel and from the outlet nozzle. In more detail, the valve element of the main hydrant valve has a valve stem 44 extending upwardly therefrom through the barrel sections 24 and 22 of the barrel 20, the valve stem 44 being operatively connected to operating means 46 which extend out of the closed upper end or bonnet 26 of the barrel in the form of an operating nut 48.

The fire hydrant 10 just described is known in the trade as a "dry barrel" hydrant in that the main operating valve 14 is located in the shoe 12 which is buried in the ground below the frost line so that freezing weather conditions do not affect the operation of the hydrant. This type of hydrant is distinguished from a "wet barrel" hydrant used in warm climates, the usual "wet barrel" hydrant having its hydrant valve located adjacent its outlet or pumper nozzle. With "wet barrel" hydrants there is little or no problem with regard to head or flow loss between the shoe inlet opening and the nozzle outlet as the shoe is unobstructed by a valve element and flow of fluid is controlled right at the outlet nozzle and direct into a hose connected thereto. The "dry barrel" fire hydrant does not realize the advantages inherent in the "wet barrel" hydrant because of losses resulting from positioning of the main hydrant valve within the hydrant shoe. To date, while it is recognized that "dry barrel" fire hydrants do have head or flow losses between the shoe inlet opening and the barrel outlet nozzle and standards have been set by the American Water Works Association and the Underwriters Labratories, little effort has been made to minimize losses below the standards set of 5 psi for a flow of 1000 gpm. The traditional shapes of shoes and valve elements has resulted primarily from the convenience in casting the elbow-shaped shoes without taking into consideration the resultant flow through the shoe around the open valve and out of the shoe into the barrel. So long as the hydrant losses are below the maximum standard, manufacturers have not made an effort to understand the reason for such losses or made an effort to minimize such losses.

About eighty-five percent of the total head or flow loss of a fire hydrant occurs in the shoe/main valve area of the same. It has been discovered that the total head or flow loss of a hydrant may be materially reduced by controlling the interior bowl configuration of the hydrant shoe so that there is a gentle change in the shape of the shoe from the inlet passage to the part spherical chamber thereof to provide for a gentle expansion in the flow way as the flow is changing direction and passing around the valve element and providing an outlet from the shoe around the valve element which results in a uniform velocity of flow through and from the shoe thereby maintaining a smooth uniform flow. Additionally, it has been discovered that head or flow loss can be minimized even further by designing the valve element with a downstream surface thereof shaped to further control flow of fluid and enhance the transition of the fluid from the shoe into the barrel, thus, reducing turbulence caused by abrupt changes in flow direction against the valve stem. The aforementioned discoveries have been accomplished by providing the shoe with a part spherical chamber therein, the part spherical chamber or surface having a sphere center positioned above the axis of the inlet passage on the axis of the outlet passage with the radius of curvature of the spherical portion being greater than the radius of the inlet passage, this coupled with the provision of a diverging transitional surface of rotation between the inlet passage and the part spherical chamber, and diverging transitional surface of rotation being generally frusto conical in shape and having an axis parallel to the axis of the inlet passage; and a converging transitional surface of rotation, generally frusto conical in shape and having an axis generally parallel to the cylindrical outlet passage of the shoe. The diverging transitional surface of rotation merges smoothly with the inlet passage at a plane perpendicular to the inlet passage and merges smoothly with the part spherical chamber at a tangential intersection with the same whereas the converging transitional surface of rotation merges smoothly with the cylindrical outlet passage of the shoe and smoothly with the part spherical chamber at a tangential intersection with the same. Both the transitional diverging surface and the converging transitional surface merge smoothly with one another. To accomplish even a further minimizing of head or flow loss in the hydrant, the upper surface of the valve element is a converging surface of rotation which is generally frusto conical and extends from adjacent the maximum diameter of the valve element to the valve stem.

Figure 2:
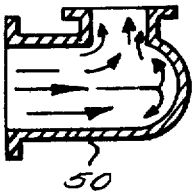
Fig. 2. PRIOR ART
FIG. 2 is a vertical sectional view of a hydrant shoe of the prior art with the valve omitted for purposes of clarity and the view schematically showing the flow path and turbulence within the shoe.
Figure 7:
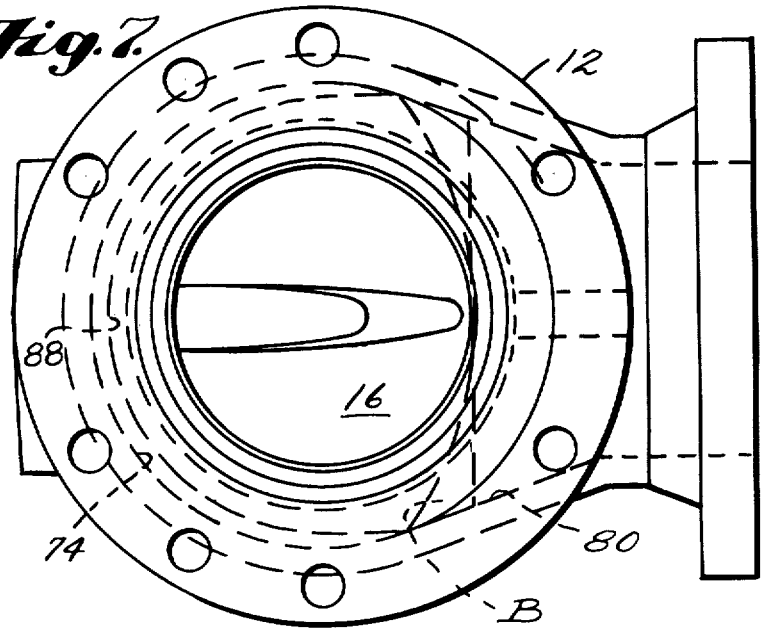
FIG. 7 is a top plan view of FIG. 6.
Figure 6:
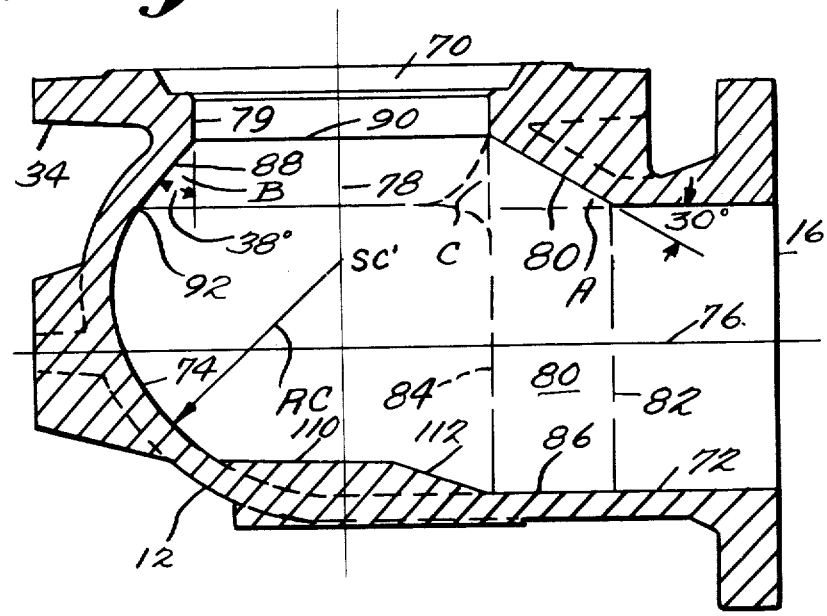
FIG. 6 is an enlarged vertical sectional view of the improved shoe of the present invention.

Referring now to FIG. 2, there is disclosed a vertical section of a commonly used shoe 50 for fire hydrants wherein the part spherical portion or chamber has a sphere center colinear with the axis of the inlet passage and on the axis of the vertical outlet passage. This type of shoe or slight variations therefrom may be found on hydrants manufactured today and it will be appreciated that although the hydrant valve element is not shown, it will be located, when in the open position, at about the intersection of the horizontal axis of the inlet passage and the vertical axis of the outlet passage. Such a shoe design results in considerable turbulence within the shoe as well as when the flow of fluid is being discharged from the shoe into the hydrant barrel as represented schematically by the arrows A and it would be obvious that this arrangement would result in considerable head or flow losses in the hydrant.

Figure 4:
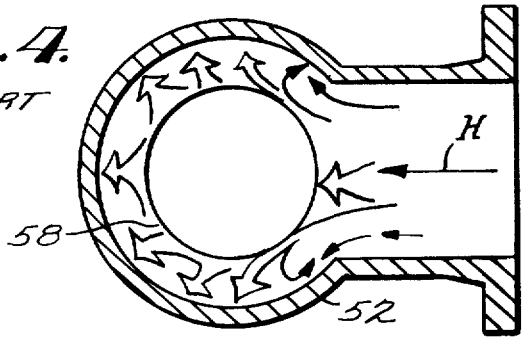
Fig. 4. PRIOR ART
FIG. 4 is a sectional view taken generally on the line 4—4 of FIG. 3.
Figure 3:
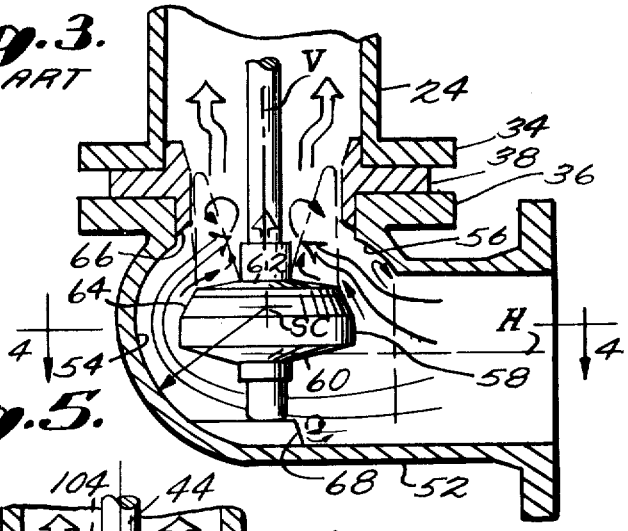
Fig. 3. PRIOR ART
FIG. 3 is a fragmentary vertical sectional view of a fire hydrant shoe and valve arrangement of the prior art, the shoe being of the type having a part spherical bowl or chamber with the spherical center positioned above a horizontal axis through the cylindrical inlet passage and on the vertical axis of the cylindrical outlet passage, the view schematically showing the turbulent flow path in the shoe.

More recently hydrants of the type shown in FIGS. 3 and 4 have been manufactured, these hydrants being provided with a shoe 52 having a part spherical chamber or surface 54 with a spherical center SC positioned above the horizontal axis H of the inlet passage and on the vertical axis V of the outlet passage. However, in such hydrants utilizing a shoe 52, there is a sharp change of direction as indicated at 56 between the inlet passage and the outlet passage, this change of direction either being concave as shown or convex. The valve element 58 is also of the standard type having a lower valve plate 60, a generally planar upper valve plate 62 with an upwardly facing frusto conical seating surface 64 for engaging the downwardly facing frusto conical valve seat ring 66. While such a design of shoe 52 reduced head or flow losses of the hydrant over a shoe design such as the shoe 50 of FIG. 2, there were still material head and flow losses because of the sharp change in direction at 56 causing turbulence as well as flow losses around the valve element 58 caused by the flow striking the valve stem at a sharp angle. Additionally, there were some flow losses in the area of the valve stop 68 where the flow of incoming fluid hits the blunt end of the stop although the flow of fluid beneath the valve element when the valve element was in the open position was smoother since the spherical shape of the bowl had a larger curvature in which to turn the direction of the incoming fluid smoothly upwardly and around the back side of the valve.

Referring now to FIGS. 5–10 inclusive, there is illustrated the improved shoe/main valve area of the fire hydrant 10 of the present invention. In this respect, the hydrant shoe 12 is provided with the inlet opening 16 which lies in a plane perpendicular to the upwardly opening mouth 70. A cylindrical inlet passage 72 having a horizontal axis 76 extends from the inlet opening 16 to the interior of the bowl of the shoe 12 which defines a part spherical chamber as indicated at 74. In this respect, the part spherical chamber 74 has a sphere center SC' positioned above the horizontal axis 76 of the inlet passage 72 and on a vertical axis 78 of a cylindrical outlet passage 79 which extends from the upwardly opening mouth 70 to the interior of the shoe 12. The part spherical chamber or surface 74 has a radius or curvature RC which is greater than the radius of the cylindrical inlet passage 72. The shoe 12 thus far described is somewhat similar to the shoe 52 shown in FIGS. 3 and 4 and representing the prior art.

However, the shoe 12 of the present invention is provided with a diverging transitional surface of rotation 80 which extends from a plane 82 perpendicular to the axis 76 of the cylindrical inlet passage 72. The diverging transitional surface of rotation 80 merges smoothly with the part spherical chamber 74 at a tangent thereto as indicated at 84 and is generally frusto conical in shape with its maximum angle to an axis parallel to the axis 76 being shown at A in FIG. 6. The diverging transitional surface of rotation 80 has an axis which is parallel to the horizontal axis 76 of the inlet passage 72 and it will be noted that this diverging transitional surface of rotation will merge smoothly with the lower portion of the inlet passage 72 as indicated at 86 in FIGS. 6 and 8. In this respect, the angle of the diverging transitional surface 80 with respect to an axis parallel to the axis 76 approaches 0° in the area of the lower portion of the inlet passage where it merges with both the inlet passage 72 and the part spherical chamber 74. Thus it will be seen that from the maximum angle A of the diverging transitional surface 80, the angle will decrease as the surface of rotation extends downwardly from the position shown in FIG. 6 and around its axis of revolution. It has been found that to provide a gentle expansion of fluid so that it can make a gentle turn into the area of the open valve 14 and so that it can expand around the valve and flow upwardly with a minimum of turbulence, the maximum angle A should be in the range of 25° to 35° and preferably in the order of 30°.

The shoe 12 of the present invention is further provided with a converging transitional surface of rotation 88 which extends from a plane 90 perpendicular to the vertical axis 78 of the cylindrical inlet passage 72 to and merges smoothly with the part spherical chamber 74 at a tangent thereto as indicated at 92. This converging transitional surface of rotation 88 is also generally frusto conical in shape and is provided with a maximum angle to a vertical axis parallel to the axis 78 as shown at B. The axis of the converging transitional surface or rotation is parallel to the vertical axis 78 and it will be noted that it merges smoothly with the diverging transitional surface of rotation 80 in an area indicated at B in FIG. 6. As the surface 88 revolves from the position of its maximum angle B around the part spherical chamber of the shoe its angle will decrease to the point where it merges as indicated at C with the diverging transitional surface of rotation 80. It has been found that the maximum angle B of the converging transitional surface of rotation 88 in order to provide laminar flow characteristics about the open valve 14 should be in the range of 30° to 45° and preferably in the order of 38°.

The valve element 42 of the main hydrant valve 14 is provided with the usual lower valve plate 94 and is held on the valve stem 44 by a cap nut 96. A rubber or rubber like valve ring 98 having an upwardly converging frusto conical seating surface is arranged to seat on the downwardly facing valve seat 40 of the valve seat ring member 38 when the valve is closed. An upper valve plate generally designated at 100 and best shown in FIGS. 9 and 10 is provided on the upper side of the valve ring 98. The upper valve plate 100 instead of being generally flat such as the valve element shown in FIG. 3, is provided with a converging frusto conical surface of rotation 102 which extends from adjacent the maximum diameter of the valve element 42 substantially to the valve stem 44. The frusto conical converging surface of rotation 102 of the upper valve plate 100 has an angle with the vertical axis 78 of the cylindrical outlet passage 80 in the range of 40° to 50° and is preferably 45°. The upper valve plate 100 is provided with a pair of longitudinally and upwardly extending ribs 104 which ride in longitudinal grooves (not shown) provided in the valve seat ring 38, the ribs 104 functioning to stiffen the upper valve plate and to restrict the valve element 42 and valve stem 44 from rotating while permitting vertical reciprocation between the open and closed position of the main valve 14. The ribs 104 carry the usual drain valve facing strips 106 and it will be noted that the ribs 104 taper inwardly in a radial direction of the valve plate element 100 as well as taper upwardly in a vertical direction so as to make the same as streamlined as possible to further promote uniform flow.

Figure 5:
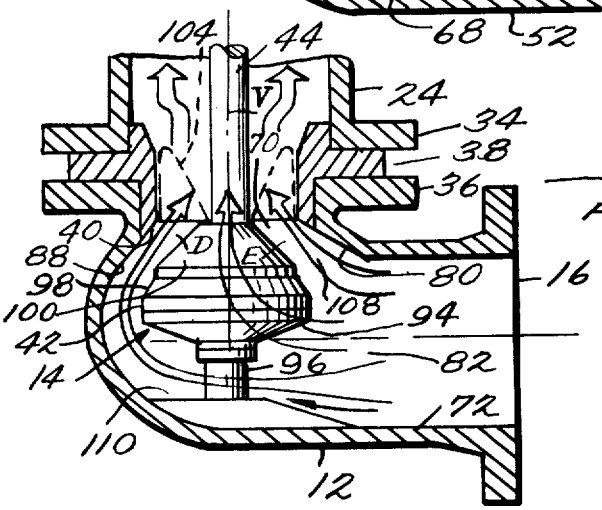
FIG. 5 is a fragmentary vertical sectional view of a shoe and valve element of the present invention, the view illustrating the uniform flow path of fluid through the shoe schematically.

When the valve element 42 is in the open position as shown in FIG. 5, the converging surface of rotation 102 of the upper valve plate 100 defines with the converging transitional surface of rotation 88 and the diverging surface of rotation 80 of shoe 12 an annular flow passage 108. It will be noted that the annular passage 108 varies in radial section from a diverging radial section at D located at the midpoint of said converging transitional surface of rotation 88 of said shoe 12 to a converging radial section E at the midpoint of said diverging transitional surface of rotation 80 of the shoe 12. Such an arrangement provides a uniform flow velocity of fluid through the open valve into the barrel of the hydrant resulting in maintaining as much as possible a uniform flow which reduces head loss. The converging surface of rotation 102 of the upper valve plate gently guides the water against the valve stem rather than sharply, thus eliminating turbulence in this area.

FIG. 11 discloses a modified upper valve plate 100' which has a converging surface of rotation 102' that is slightly concave with a large radius. Any chord F of the concave surface of rotation 102' must have an angle with a vertical axis in the range of 40° to 50° and preferably in the order of 45°. Such an arrangement as shown in FIG. 11 when utilized with the improved shoe 12 will function to enhance uniform flow from the shoe/valve area to the barrel, just as the valve plate 100 does as described above.

A valve stop 110 is provided in the bottom of the shoe 12 and it will be noted that the valve stop 110 is elongated and aligned with the axis of the cylindrical inlet passage 72. Additionally, the stop 110 is streamlined at 112 so as to gently split the flow stream engaging the leading edge thereof.

Tests have been run to prove the superiority of the hydrant shoe/main valve arrangement of FIG. 5 over the hydrant shoe/main valve arrangement of FIG. 3. In more detail, a first series of tests was conducted on the shoe/main valve arrangement of FIG. 3 with the hydrant barrel removed, the test determining the pressure loss in pounds per square inch at a flow rate of 1000 gallons per minute. One test was run with the ribs of the valve element arranged perpendicular to the flow through the cylindrical inlet passage whereas a second test was run with the ribs of the valve element arranged parallel to the flow of the fluid through the cylindrical inlet passage. A second series of tests were run on a hydrant shoe/main valve arrangement without a hydrant barrel but this time utilizing the improved shoe 12 of FIGS. 5 and 6 but with a conventional valve element such as shown in FIG. 3 and used in the first test series. These tests were done with the ribs of the valve element perpendicular to the flow of the fluid through the cylindrical inlet passage as well as parallel to the flow of fluid through the cylindrical inlet passage. A third series of tests were run on a hydrant shoe/main valve arrangement without a hydrant barrel but this time utilizing the improved shoe arrangement of FIGS. 5 and 6 as well as the improved valve element of FIG. 5 having the improved upper valve plate shown in detail in FIGS. 9 and 10. This third series of tests also included tests where the ribs of the valve element were perpendicular to the flow through the cylindrical inlet passage of the shoe and parallel to the flow through the cylindrical inlet passage of the shoe. In each instance, the cylindrical inlet passage of the shoes tested was six inches in diameter with the maximum diameter of each of the valve elements being 5¼ inches in diameter. The results of the above mentioned tests are as follows:

| | | PRESSURE LOSS IN PSI AT 1000 GPM | |
|---|---|---|---|
| Test Series | Shoe/Main Valve Arrangement | Ribs Of Valve Element Perpendicular To Flow Of Inlet | Ribs Of Valve Element Parallel To Flow Of Inlet |
| 1 | Shoe and Valve Element of FIG. 3 | 2.09 PSI | 2.10 PSI |
| 2 | Shoe of Invention FIG. 5 and Valve Element of FIG. 3 | 1.90 PSI | 1.97 PSI |
| | % Decrease in pressure loss of 2 over 1 | 9% | 6% |
| 3 | Shoe of Invention FIG. 5 and Valve Element of Invention FIG. 5 | 1.71 PSI | 1.85 PSI |
| | % Decrease in pressure loss of 3 over 1 | 18% | 12% |
| | % Decrease in pressure loss of 3 over 2 | 9% | 6% |

From the above tests it will be noted that in test series 2 where the improved shoe design of the present invention was used with the conventional valve element design of FIG. 3, there was a 9% decrease in pressure loss over the arrangement of FIG. 3 utilizing a conventional shoe and a conventional valve element when the ribs of the valve element were perpendicular to the flow of the inlet passage and a 6% decrease in pressure loss where the ribs were parallel to the flow of the inlet passage. When the shoe of the present invention was tested with the improved valve element of the present invention in test series 3, there was a still further marked improvement in the decrease in pressure loss over the conventional shoe and valve element of FIG. 3 used in test series 1, this improvement being a 18% decrease in loss of pressure when the ribs of the valve element were perpendicular to the flow of the inlet passage and a 12% decrease in loss of pressure when the ribs were parallel to the flow of the inlet passage. In fact, the shoe/main valve arrangement of test series 3 showed a marked decrease in pressure loss over the shoe/main valve arrangement of test series 2 wherein the improved shoe of FIG. 5 was utilized but it will also be noted that there is a marked improvement in the decrease in pressure loss when an improved shoe of the invention such as the shoe of FIG. 5 is utilized with a conventional valve element over the conventional shoe/main valve arrangement of FIG. 3.

By providing the shoe/main valve arrangement of the present invention in a fire hydrant, the flow or head loss of the improved hydrant is so minimized as compared to conventional hydrants that hydrants having smaller inlet passages and smaller valve diameters may be used to give the equivalent flow or capacity of larger conventional hydrants. This gives the customer an added choice and versitility in selecting fire hydrants based on a capacity criterion such as head loss.

The terminology used in this specification is for the purpose of description and not limitation, the scope of the invention being defined by the claims.

What is claimed is:

1. In a fire hydrant comprising:

a barrel closed at its upper end and open at its lower end, said barrel having at least one outlet nozzle adjacent its upper end;

an elbow shaped hydrant shoe having one end with an upwardly opening mouth, said one end being attached to the lower end of said barrel, and another end with an inlet opening lying in a plane substantially 90° to a plane of the upwardly opening mouth, said other end being arranged to be attached to a water main;

a downwardly facing valve seat ring positioned in the one end of said shoe adjacent the upwardly opening mouth;

a valve element arranged to seat on said valve seat ring;

a reciprocating valve stem extending from said valve element upwardly within said barrel; and operating means connected to said valve stem and extending out of the closed end of said barrel, the improvement in interior configuration of said shoe for minimizing flow loss of the hydrant between the inlet opening of said shoe and the outlet nozzle of said barrel, said improvement comprising said shoe having a cylindrical inlet passage extending from said inlet opening and a cylindrical outlet passage extending from said upwardly opening mouth, a part spherical chamber communicating with said cylindrical inlet passage and said cylindrical outlet passage, said part spherical chamber having a spherical center positioned above the axis of said cylindrical inlet passage and on the axis of said cylindrical outlet passage, a diverging transitional surface of rotation having a generally part frusto-conical shape with an axis generally parallel to the axis of said cylindrical inlet passage and said diverging transitional surface of rotation extending from a plane perpendicular to the cylindrical inlet passage and smoothly merging with said part spherical chamber at a tangential intersection with the same, and a converging transitional surface of rotation having a generally part frusto-conical shape with an axis generally parallel to the axis of said cylindrical outlet passage, said converging transitional surface of rotation extending smoothly from a tangential intersection with said part spherical chamber to a plane extending perpendicularly to an axis of said cylindrical outlet passage, said converging transitional surface merging smoothly with said diverging transitional surface.

2. A fire hydrant as claimed in claim 1 in which said converging transitional surface of rotation extends at least half way around said cylindrical outlet passage to a position where said converging transitional surface of rotation smoothly merges with said diverging transitional surface of rotation.

3. A fire hydrant as claimed in claim 2 wherein said diverging transitional surface of rotation merges smoothly with said cylindrical inlet passage adjacent a vertical plane through the axis of the cylindrical inlet passage.

4. A fire hydrant as claimed in claim 1 in which said converging transitional surface of rotation has a maximum angle relative to the axis of the cylindrical outlet passage in the order of 30° to 45° and in which said diverging transitional surface of rotation has a maximum angle with the horizontal axis of the cylindrical inlet passage in the order of 25° to 35°.

5. A fire hydrant as claimed in claim 4 in which the maximum angle of said converging transitional surface of rotation is preferably in the order of 38°.

6. A fire hydrant as claimed in claim 4 in which the maximum angle of said diverging transitional surface of rotation is preferably in the order of 30°.

7. A fire hydrant as claimed in claim 4 in which the maximum angle of said converging transitional surface of rotation is in the order of 38° and in which the maximum angle of said diverging transitional surface of rotation is in the order of 30°.

8. A fire hydrant as claimed in claim 1 in which said converging transitional surface of rotation has a maximum angle with the axis of said cylindrical outlet passage lying in a plane extending through the axis of said outlet passage and through the axis of said inlet passage.

9. A fire hydrant as claimed in claim 1 in which said diverging transitional surface of rotation has a maximum angle with the axis of said cylindrical inlet passage lying in a plane extending through the axis of said outlet passage and through the axis of said inlet passage.

10. A fire hydrant as claimed in claim 1 in which said converging transitional surface of rotation of said shoe has a maximum angle with the axis of said cylindrical outlet passage lying in a plane extending through the axis of said outlet passage and through the axis of said inlet passage and in which said diverging transitional surface of rotation of said shoe has a maximum angle lying in a plane extending through the axis of said outlet passage and through the axis of said inlet passage.

11. A fire hydrant as claimed in claim 10 in which the maximum angle of said converging transitional surface of rotation is in the order of 30° to 45° and in which the maximum angle of said diverging transitional surface of rotation is in the order of 25° to 35°.

12. A fire hydrant as claimed in claim 11 in which the maximum angle of said converging transitional surface of rotation is preferably in the order of 38° and in which said maximum of said diverging transitional surface of rotation is in the order of 30°.

13. An elbow shaped hydrant shoe having one end with an outlet opening and another end with an inlet opening lying in a plane substantially 90° to the plane of the outlet opening, said elbow shaped hydrant shoe having an improved interior configuration for minimizing flow loss, said improved configuration comprising said shoe having a cylindrical inlet passage extending from said inlet opening and a cylindrical outlet passage extending from said outlet opening, a part spherical chamber communicating with said cylindrical inlet passage and said cylindrical outlet passage, said part spherical chamber having a spherical center positioned above the axis of said cylindrical inlet passage and on the axis of said cylindrical outlet passage, a diverging transitional surface of rotation having a generally part frusto-conical shape with an axis generally parallel to the axis of said cylindrical inlet passage and said diverging transitional surface of rotation extending from a plane perpendicular to the cylindrical inlet passage and smoothly merging with said part spherical chamber at a tangential intersection with the same, and a converging transitional surface of rotation having a generally part frusto-conical shape with an axis generally parallel to the axis of said cylindrical outlet passage, said converging transitional surface of rotation extending smoothly from a tangential intersection with said part spherical chamber to a plane extending perpendicularly to an axis of said cylindrical outlet passage, said converging transitional surface merging smoothly with said diverging transitional surface.

14. An elbow shaped hydrant shoe as claimed in claim 13 in which said converging transitional surface of rotation extends at least half way around said cylindrical outlet passage to a position where said converging transitional surface of rotation smoothly merges with said diverging transitional surface of rotation.

15. An elbow shaped hydrant shoe as claimed in claim 14 wherein said diverging transitional surface of rotation merges smoothly with said cylindrical inlet passage adjacent a vertical plane through the axis of the cylindrical inlet passage.

16. An elbow shaped hydrant shoe as claimed in claim 13 in which said converging transitional surface of rotation has a maximum angle relative to the axis of the cylindrical outlet passage in the order of 30° to 45° and in which said diverging transitional surface of rotation has a maximum angle with the horizontal axis of the cylindrical inlet passage in the order of 25° to 35°.

17. An elbow shaped hydrant shoe as claimed in claim 16 in which the maximum angle of said converging transitional surface of rotation is preferably in the order of 38°.

18. An elbow shaped hydrant shoe as claimed in claim 16 in which the maximum angle of said diverging transitional surface or rotation is preferably in the order of 30°.

19. An elbow shaped hydrant shoe as claimed in claim 16 in which the maximum angle of said converging transitional surface of rotation is in the order of 38° and in which the maximum angle of said diverging transitional surface of rotation is in the order of 30°.

20. An elbow shaped hydrant shoe as claimed in claim 13 in which said converging transitional surface of rotation has a maximum angle with the axis of said cylindrical outlet passage lying in a plane extending through the axis of said cylindrical outlet passage and through the axis of said cylindrical inlet passage.

21. An elbow shaped hydrant shoe as claimed in claim 13 in which said diverging transitional surface of rotation has a maximum angle with the axis of said cylindrical inlet passage lying in a plane extending through the axis of said cylindrical outlet passage and through the axis of said cylindrical inlet passage.

22. An elbow shaped hydrant shoe as claimed in claim 13 in which said converging transitional surface of rotation of said shoe has a maximum angle with the axis of said cylindrical outlet passage lying in a plane extending through the axis of said outlet passage and through the axis of said inlet passage and in which said diverging transitional surface of rotation of said shoe has a maximum angle lying in a plane extending through the axis of said outlet passage and through the axis of said inlet passage.

23. An elbow shaped hydrant shoe as claimed in claim 22 in which the maximum angle of said converging transitional surface of rotation is in the order of 30° to 45° and in which the maximum angle of said diverging transitional surface of rotation is in the order of 25° to 35°.

24. An elbow shaped hydrant shoe as claimed in claim 23 in which the maximum angle of said converging transitional surface of rotation is preferably in the order of 38° and in which said maximum angle of said diverging transitional surface of rotation is in the order of 30°.

* * * * *